United States Patent [19]

Burlet et al.

[11] Patent Number: 4,911,867

[45] Date of Patent: Mar. 27, 1990

[54] PROCESS FOR PREARING POLYOLEFIN FILAMENTS HAVING GREAT ADHESIVE STRENGTH FOR POLYMERIC MATRICES, AS WELL AS FOR PREPARING REINFORCED MATRIX MATERIALS

[75] Inventors: Rudolf J. H. Burlet, Geleen; Johannes H. H. Raven, Stein; Pieter J. Lemstra, Brunssum, all of Netherlands

[73] Assignee: Stamicarbon B.V., Geleen, Netherlands

[21] Appl. No.: 129,354

[22] Filed: Nov. 30, 1987

Related U.S. Application Data

[63] Continuation of Ser. No. 934,995, Nov. 26, 1986, abandoned, which is a continuation of Ser. No. 817,393, Jan. 9, 1986, abandoned, which is a continuation of Ser. No. 679,410, Dec. 7, 1984, abandoned.

[30] Foreign Application Priority Data

Dec. 13, 1983 [NL] Netherlands ..... 8304275

[51] Int. Cl.[4] ..... D02J 3/00; D01F 11/06

[52] U.S. Cl. ..... 264/22; 264/83; 264/136; 264/137; 264/210.8; 264/257; 156/272.6; 204/165

[58] Field of Search ..... 264/22, 83, 136, 137, 264/210.8, 257; 156/272.6, 166; 204/168, 165

[56] References Cited

U.S. PATENT DOCUMENTS

| | | | |
|---|---|---|---|
| 3,523,850 | 8/1970 | Uhline | 156/272.6 |
| 3,563,870 | 2/1971 | Tung et al. | 264/22 |
| 3,676,249 | 7/1975 | Lemelson | 156/272.6 |
| 4,029,876 | 6/1977 | Beatty et al. | 264/22 |
| 4,310,478 | 1/1982 | Balslev et al. | 264/22 |
| 4,328,324 | 5/1982 | Kock et al. | 204/168 |
| 4,344,908 | 8/1982 | Smith et al. | 264/204 |
| 4,411,854 | 10/1983 | Maurer et al. | 264/205 |
| 4,422,993 | 12/1983 | Smith et al. | 264/290.5 |
| 4,430,383 | 2/1984 | Smith et al. | 264/210.8 |
| 4,436,689 | 3/1984 | Smith et al. | 264/204 |
| 4,504,349 | 3/1985 | Ueno et al. | 156/272.6 |

FOREIGN PATENT DOCUMENTS

| | | | |
|---|---|---|---|
| 0006275 | 1/1980 | European Pat. Off. . | |
| 0062491 | 10/1982 | European Pat. Off. . | |
| 1128644 | 4/1962 | Fed. Rep. of Germany | 204/165 |
| 81/00252 | 2/1981 | PCT Int'l Appl. . | |
| 82/03819 | 11/1982 | PCT Int'l Appl. | 156/272.6 |
| 2026379 | 2/1980 | United Kingdom . | |

OTHER PUBLICATIONS

World Textile Abstracts, Shirley Institute, 1979/8999, p. 1360.

World Textile Abstracts, Shirley Institute, 1981/6538, p. 920.

World Textile Abstracts, Shirley Institute, 1983/4688, p. 462.

World Textile Abstracts, Shirley Institute, 1983/3379, p. 336.

World Textile Abstracts, Shirley Institute, 1983/947, p. 100.

World Textile Abstracts, Shirley Institute, 1983/5081, p. 499.

Polymer, 1985, vol. 26, Aug., pp. 1372–1384.

*Primary Examiner*—Hubert C. Lorin

*Attorney, Agent, or Firm*—Cushman, Darby & Cushman

[57] ABSTRACT

The adhesive strength of highly oriented, highmolecular polyolefin filaments for polar polymeric matrices is improved by subjecting the filaments to a corona treatment with a total irradiation dosage of $$0.05 - 3.0 \frac{\text{Watt} \cdot \text{minute}}{\text{m}^2}$$

effected intermittently in several smaller dosages.

The process is particularly suited for treating superstrong polyethylene fibers, and making reinforced materials while applying as matrix a polyester, polyamide or epoxy resin.

6 Claims, 1 Drawing Sheet

Figure 1:
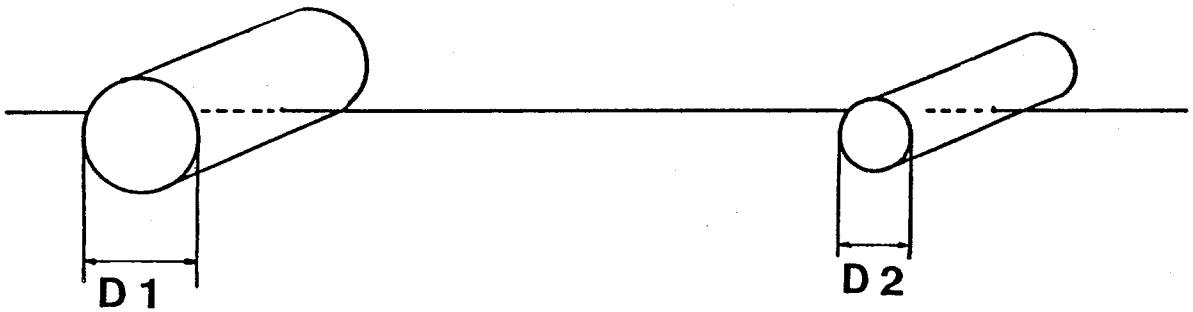

PROCESS FOR PREARING POLYOLEFIN FILAMENTS HAVING GREAT ADHESIVE STRENGTH FOR POLYMERIC MATRICES, AS WELL AS FOR PREPARING REINFORCED MATRIX MATERIALS

This is a continuation of application Ser. No. 934,995, filed Jan. 9, 1987, which was abandoned upon the filing hereof. Application Ser. No. 934,995 was a continuation of application Ser. No. 817,393, filed Jan. 9, 1986, now abandoned. Application Ser. No. 817,393 was, in turn, a continuation of application Ser. No. 679,410, filed Dec. 7, 1984, now abandoned.

The invention relates to a process for improving the adhesive strength of polyolefin filaments to polymeric matrices, as well as for preparing matrix materials reinforced with these filaments.

It is known in the art how to prepare composite reinforced materials by incorporating (embedding) in a matrix material, particularly a polymer matrix material, a reinforcing material, for instance in the form of filaments. Examples of reinforcing materials include inorganic substances, such as glass fibres, and synthetic materials, such as polymer fibres. Highly attractive as reinforcing material seem to be, prima facie, polyolefin filaments on account of, among other things, their low specific gravity, their low raw materials costs and their good chemical resistance. Prerequisites for applying such filaments as reinforcing material are a high tensile strength and a high modulus.

It is known in the art how to prepare filaments having a high tensile strength and modulus on the basis of solutions of high-molecular polyolefins, particularly polyethylene, see U.S. Pat. Nos. 4,344,908; 4,422,993; 4,430,383; 4,411,854 and 4,436,689. It has been found, however, that the adhesive power of the resulting fibres to polar polymeric materials, which fibres consist of highly oriented polyolefin material as a result of the degree of stretching applied, is too small for many practical applications.

It has already been proposed (see EP-A-No. 62.491) to adhere and to embed polyolefin materials to and in thermosetting and thermoplastic matrices. According to this known process a highly oriented polymer material, for instance in the form of a fibre or film, having a stretch ratio of at least 12:1, is subjected for that purpose to a plasma discharge treatment, preferably after etching with chromic acid. The polymer material used in that process particularly consists of melt-spun fibres of polyethylene, polypropylene or copolymers of these with a weight-average molecular weight lower than 300,000, a tensile strength of about 1 GPa and a modulus of 30–40 GPa.

A disadvantage of the known process is that in the process the strength of the fibre deteriorates vary badly and that in a virtually linear manner with the increase in adhesive strength.

The present invention now provides a process for improving the adhesive strength of highly oriented polyolefin filaments to polymeric matrices without any real deterioration of the strength of the filaments.

The invention therefore relates to a process for preparing polyolefin filaments with great adhesive strength for polar polymeric matrices, which process is characterized in that a highly oriented polyolefin filament obtained by converting a solution or melt of a polyolefin having a weight-average molecular weight of at least $4\times10^5$ into a gel filament and stretching the resulting gel filament at elevated temperature in a stretch ratio of at least 10:1 is subjected to a corona treatment with a total irradiation dosage of $$0.05\text{–}3.0\ \frac{\text{Watt}\cdot\text{minute}}{m^2}$$

carried out intermittently in dosages of $$0.01\text{–}0.15\ \frac{\text{Watt}\cdot\text{minute}}{m^2}.$$

The application of a corona treatment with plastics is known in itself, particularly for improving the printing properties of synthetic films, see for instance Tappi 65 (August 1981) no. 8, pp. 75–78, and Polymer Engineering and Science, 20 (March 1980) no. 5, pp. 330–338. In this treatment the adhesion of these films, for instance from low-molecular and weakly oriented polyethylene, for coatings or ink is improved.

In the present invention the starting material is a highly oriented polyolefin filament which has a stretch ratio higher than 10:1 and in particular higher than 20:1. In particular polyolefin filaments are used that have been obtained by gel-spinning a solution of a high-molecular polyolefin with subsequent stretching, which filaments have a very high tensile strength, for instance in the case of polyethylene higher than 2 GPa and a very high modulus, for instance higher than 50 GPa. It has been found that after having been subjected to a corona treatment such filaments have such a great adhesive strength for polymeric matrices that, after the filaments had been embedded in these matrices, it was found that these filaments could no longer be pulled loose without breaking the filament. The tensile strength and modulus of the filaments thus treated were found in the process not to be lower or to be hardly lower than that of the untreated filaments.

It was found that the treated filaments, unlike those treated according to the known processes, retained their adhesive strength for a long time. Even after more than four weeks' storage the filaments treated according to the invention could be embedded in a matrix of polymeric material while the adhesive strength between filament and matrix was hardly smaller than if embedded immediately after the corona treatment.

Surprisingly, the present process produced yet an extra advantage, namely an increase of the melting point of the filaments after embedding. This is very important for a number of technical applications, specially in the use of filaments of polyethylene, which is known to have a relatively low melting point. The increase of the melting point of polyethylene—embedded in a matrix—was found to be about 8° C.

In the present process the filament is passed through a high-frequency electric field generated, for instance, between an electrode and a guide roller by means of a high-frequency generator and a transformer. The frequency used in this process is generally 10,000 to 30,000 Hz. In order to produce a very finely distributed haze of discharges on the filament the electrode is brought very close to the roller, for instance 0.5–5 mm. In this process the filament or fibre may, for instance, be glued to a reel of film by which it is guided, or be glued to the guide roller. Preference is given to an in-line corona treatment in the winding or after the stretching of the fibre, in which treatment a number of electrodes are used arranged in series.

It has been found that in consequence of the treatment the temperature of the filament rises. The temperature of the filaments must, of course, be prevented in the process from locally exceeding the melting temperature. To this end the filaments to be treated can, on the one side, for instance, be supplied at ambient temperature and on the other side the chosen dosage to be treated will be such that the temperature does not locally exceed the melting temperature. To this end an intermittent treatment is applied with small dosages. Moreover, it has been found that in an intermittent treatment the mechanical properties of the filament remain virtually the same when the dosage to be treated increases, whereas in the event of a large supplementary increase of the dosage to be treated, i.e. increase of the energy output per unit of time, the mechanical properties decrease.

The total required dosage to be treated may vary, depending in part on the nature of the filament and the matrix and the adhesive strength desired. Generally, a dosage of 0.05–3.0, particularly 0.1–2.0, and preferably $$0.2\text{–}0.5\ \frac{\text{Watt} \cdot \text{minute}}{m^2}$$

will be used. As the filament has been found to melt when applying a single dosage larger than or equal to about $$0.4\ \frac{\text{Watt} \cdot \text{minute}}{m^2},$$

and—as explained above—a number of intermittent dosages are more advantageous than a single dosage, there is applied an intermittent treatment with small dosages of about $$0.01\text{–}0.15\ \frac{\text{Watt} \cdot \text{minute}}{m^2}$$

In this treatment the spaces of time between the dosages are not directly critical. In view of the throughput rate required for technical realization, which is in order of the spinning rate, this space of time will generally, with the usual roller diameter, be smaller than 1 second.

The present process may possibly be carried out in an inert atmosphere, such as nitrogen, but is preferably carried out in the presence of a reactive gas, such as oxygen or carbon dioxide or air with a low (<1%) relative humidity.

The highly oriented polyolefin filament used in the present process may in the first place be a polyethylene filament, more in particular a filament obtained by gel spinning a solution of linear polyethylene with a weight average molecular weight higher than $4\times10^5$, which may contain a considerable amount of filler, followed by stretching at elevated temperature in a stretch ratio of at least 10, preferably at least 20.

High-molecular linear polyethylene is in this connection understood to mean polyethylene that may contain minor amounts, preferably 5 moles % at most, of one or more alkenes copolymerized with it, such as propylene, butene, pentene, hexene, 4-methylpentene, octene, etc., having fewer than 1 side chain per 100 carbon atoms and preferably fewer than 1 side chain per 300 carbon atoms. The polyethylene may contain minor amounts, preferably 25% (wt) at most, of one or more other polymers, particularly an alkene-1-polymer such as polypropylene, polybutene or a copolymer of propylene with a minor amount of ethylene. Besides, the filament used may also be a filament based on a highly oriented polypropylene or ethylene-propylene copolymer.

The filaments obtained according to the invention can be used in polymeric matrices in a manner known per se, for instance impregnation of fabrics and winding. A general survey of techniques customary in this connection is given in 'Handbook of Composites' by Luben, G., published 1982 with van Nostrand Reinhold Co. (New York).

As polymeric matrix generally any polar polymeric material can be used, such as epoxy, phenol, vinylester, polyester, acrylate, cyanoacrylate and polymethylmethacrylate resins and polyamide materials can be used. The matrix used is preferably a polyamide, polyester or epoxy resin.

The resulting reinforced matrices have a very wide technical use, as in boats, surf boards, aircraft and glider parts, printing plates, car parts, for instance bonnet, wings, etc.

The invention is further elucidated in the following examples without, however, being limited thereto.

EXAMPLE I

High-molecular polyethylene fibres having a tensile strength of 2.1 GPa, a modulus of 60 GPa and a filament titre of 20 dtex prepared via gel spinning of a polyethylene solution (weight-average molecular weight about $1.5\times10^6$) according to the process described in U.S. Pat. No. 422,993 were subjected to a corona treatment in an apparatus of the Mark II type of the firm of Vetaphone. Direct dosaging as well as intermittent treatment were applied.

Of the fibres treated the tensile strength and modulus were determined. The results are summarized in Table I.

TABLE I

| Corona fibre treatment | Tensile strength (GPa) | Modulus (GPa) |
|---|---|---|
| Reference | 2.1 | 60 |
| Corona - direct (0.2 W. min/m$^2$) | 1.8 | 52 |
| Corona - direct (0.3 W. min/m$^2$) | 1.4 | 43 |
| Corona - intermittent (5 × 0.1 W. min/m$^2$) | 2.0 | 62 |
| Corona - intermittent (10 × 0.1 W. min/m$^2$) | 2.0 | 59 |

EXAMPLE II

An epoxy resin mixture consisting of 100 parts by weight of a resin, type Europox 730 (RTM) and 15 parts by weight of a hardener, type XE 278 (RTM), available from the firm of Schering, were cast into a mould. Subsequently polyethylene fibres of a composition described in Example I subjected or not subjected to a corona treatment were embedded and the whole of it was hardened at 60°–110° C.

Execution: Into a cylindrical casting mould of silicone rubber with an inside diameter of D mm and previously cut into to half-way its length the liquid resin was cast before hardening. Subsequently the fibre was embedded in the mould via the incision of the silicone rubber, and the whole was hardened at elevated temperature.

Now, by embedding in two silicone rubber moulds the configuration resulted as represented diagrammatically in FIG. 1.

After hardening, the pull-out strength was measured by means of an Instron-1195 tensile tester with specially adapted grips for the cylindrical test bars.

The grip length of the fibre between the two cylindrical matrices was 150 mm, and the length of each of the two cylindrical matrices was 30 mm.

The drawing speed was always 1 mm/min and measurements were made at room temperature and 60% relative humidity. In the experiments the chosen diameters were $D_1=9$ mm and $D_2=5$ mm.

The adhesive strength between the fibres and the matrix was tested by means of a so-called pull-out test. In order to be able to properly differentiate between the treated and non-treated fibres mutually, it is important for the fibre-matrix interface to be adjusted and to be chosen correctly. For if the fibre-matrix interface is too large, for instance if the length of embedment is too large, the fibre will break in a pull-out test and no differentiation will occur between the fibres.

The results are summarized in Table II.

EXAMPLE III

In the same way as in Example II polyethylene fibres (as described in Example I) were embedded in a polyester resin mixture available from the firm of Synres consisting of 50 parts by weight resin, type Synolite S 593 (RTM), 1 part by weight accelerator, type cobaltoctoate NL 49 (RTM) and 1 part by weight hardener, type peroxide butanox N 50 (RTM), and the whole of it was hardened at 60°-110° C.

The results are again summarized in Table II.

EXAMPLE IV

In the same way as in Example II polyethylene fibres (as described in Example I) are embedded in nylon-6 obtained by mixing caprolactam having a water content lower than 100 ppm available from the firm of DSM with an alkali-caprolactam catalyst and a di-imide accelerator in a weight ratio of 200:1:1. After casting and embedding the whole of it was subjected to after-hardening at 90°-130° C.

The results are again summarized in Table II.

TABLE II

| Fibre-Matrix system | Pull-out strength (N) |
|---|---|
| Example II | |
| (a) reference | 1.65 |
| (b) Corona 5 × 0.1 W. min/m$^2$ | 2.93 |
| (c) Corona 10 × 0.1 W. min/m$^2$ | 3.15 |
| Example III | |
| (a) reference | 0.72 |
| (b) Corona 10 × 0.1 W. min/m$^2$ | 2.45 |
| Example IV | |
| (a) reference | 0.43 |
| (b) Corona 5 × 0.1 W. min/m$^2$ | 1.85 |

TABLE II-continued

| Fibre-Matrix system | Pull-out strength (N) |
|---|---|
| (c) Corona 10 × 0.1 W. min/m$^2$ | 2.35 |

We claim:

1. Process for preparing polyolefin filaments with great adhesive strength for polar polymeric matrices, which comprises subjecting a highly oriented polyolefin filament, obtained by converting a solution or melt of a polyolefin having a weight-average molecular weight of at least $4\times10^5$ into a gel filament and stretching the resulting gel filament at elevated temperature in a stretch ratio of at least 10:1, to a corona treatment with a total irradiation dosage of $$0.05\text{–}3.0\ \frac{\text{Watt}\cdot\text{minute}}{m^2}$$

carried out intermittently in dosages $$0.01\text{–}0.15\ \frac{\text{Watt}\cdot\text{minute}}{m^2}.$$

2. Process according to claim 1 which comprises using as polyolefin a linear polyethylene which may contain up to 5 moles % of one or more olefins with 3–8 carbon atoms copolymerized with it and which has fewer than 1 side chain per 100 carbon atoms.

3. Process according to claim 1, wherein a total irradiation dosage of $$0.1\text{–}2.0\ \frac{\text{Watt}\cdot\text{minute}}{m^2}$$

is applied.

4. Process according to claim 1, which comprises carrying out the corona treatment at ambient temperature in an atmosphere containing at least one member of the group consisting of oxygen and carbon dioxide.

5. Process for preparing reinforced polymeric matrix materials which comprises incorporating into a polar polymeric matrix material, a polyolefin filament obtained by a process comprising subjecting a highly oriented polyolefin filament, obtained by converting a solution or melt of a polyolefin having a weight-average molecular weight of at least $4\times10^5$ into a gel filament and stretching the resulting gel filament at elevated temperature in a stretch ratio of at least 10:1, to a corona treatment with a total irradiation dosage of $$0.05\text{–}3.0\ \frac{\text{Watt}\cdot\text{minute}}{m^2}$$

carried out intermittently in dosages of $$0.01\text{–}0.15\ \frac{\text{Watt}\cdot\text{minute}}{m^2}.$$

6. Process according to claim 5, wherein the matrix material used is a polyamide, polyester or epoxy resin.

* * * * *

UNITED STATES PATENT AND TRADEMARK OFFICE

CERTIFICATE OF CORRECTION

PATENT NO. : 4,911,867

DATED : March 27, 1990

INVENTOR(S) : Burlet et al

It is certified that error appears in the above-identified patent and that said Letters Patent is hereby corrected as shown below:

Column 1, line 56, change "vary" to
--very--.

Column 4, line 34, change "422,993" to
--4,422,993--.

Signed and Sealed this

First Day of October, 1991

*Attest:*

HARRY F. MANBECK, JR.

*Attesting Officer*

*Commissioner of Patents and Trademarks*